US012146295B2

(12) United States Patent
Kitahara

(10) Patent No.: US 12,146,295 B2
(45) Date of Patent: Nov. 19, 2024

(54) ELECTRIC WORK MACHINE

(71) Applicant: Yanmar Holdings Co., Ltd., Osaka (JP)

(72) Inventor: Satoshi Kitahara, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 0 days.

(21) Appl. No.: 17/966,770

(22) Filed: Oct. 14, 2022

(65) Prior Publication Data

US 2023/0131436 A1 Apr. 27, 2023

(30) Foreign Application Priority Data

Oct. 21, 2021 (JP) ..... 2021-172520

(51) Int. Cl.
*E02F 9/22* (2006.01)
*E02F 9/20* (2006.01)
*E02F 9/08* (2006.01)

(52) U.S. Cl.
CPC ..... *E02F 9/2246* (2013.01); *E02F 9/207* (2013.01); *E02F 9/2091* (2013.01); *E02F 9/0866* (2013.01)

(58) Field of Classification Search
CPC ..... E02F 9/0858; E02F 9/207; E02F 9/2091; E02F 9/0866
See application file for complete search history.

(56) References Cited

U.S. PATENT DOCUMENTS

2013/0078071 A1* 3/2013 Noguchi ..... B60K 1/04 414/719
2013/0197766 A1* 8/2013 Kurikuma ..... E02F 9/2246 701/50

FOREIGN PATENT DOCUMENTS

JP 2007211395 A * 8/2007 ..... B60K 1/04
JP 2007262856 A * 10/2007 ..... B60K 1/04

* cited by examiner

*Primary Examiner* — Abiy Teka
(74) *Attorney, Agent, or Firm* — Chris Mizumoto

(57) ABSTRACT

A hydraulic excavator as an electric work machine includes a lower traveling body, an upper swivel body located above the lower traveling body and provided to be swivelable with respect to the lower traveling body, an electric motor arranged in the upper swivel body, a hydraulic pump arranged in the upper swivel body and driven by the electric motor, a battery unit arranged in the upper swivel body and storing electric power to drive the electric motor, and a hydraulic actuator driven by hydraulic oil supplied from the hydraulic pump. The upper swivel body has a swivel frame at a bottom portion thereof. The battery unit is arranged on the swivel frame. The electric motor and the hydraulic pump are arranged on the swivel frame, side by side in a left-right direction of the upper swivel body.

10 Claims, 4 Drawing Sheets

ELECTRIC WORK MACHINE

CROSS-REFERENCE

This application claims foreign priority of IP2021-172520 filed Oct. 21, 2021, the disclosure of which is hereby incorporated by reference in its entirety

TECHNICAL FIELD

The present invention relates to an electric work machine.

BACKGROUND ART

Conventionally, a hydraulic excavator that drives a hydraulic pump by an electric motor and supplies hydraulic oil from the hydraulic pump to a hydraulic actuator to drive the hydraulic actuator has been proposed (see, for example, Patent Document 1).

PRIOR ART DOCUMENT

Patent Document

Patent Document 1: Japanese Unexamined Patent Application Publication No. 2007-211394

SUMMARY OF INVENTION

Technical Problem

In the Patent Document 1, a battery for driving the electric motor is located at a rear end of an upper swivel body. The battery is located above the electric motor and the hydraulic pump in the upper swivel body. In this arrangement, the center of gravity of the hydraulic excavator is higher because the heavier battery is located above. As a result, it is difficult to maintain good balance of a machine body of the hydraulic excavator when the hydraulic actuator is driven to perform work. In particular, when a large-capacity battery (e.g., a battery unit consisting of multiple batteries) is used as the battery, if the position of the battery unit is high in the upper swivel body, or if the position of the battery unit is off-center in a left-right direction, it becomes increasingly difficult to maintain good balance of the machine body.

The present invention was made to solve the above problems, and the object is to provide an electric work machine that can maintain good balance of a machine body during work even when a large-capacity (large-size) battery unit is used.

Solution to Problem

An electric work machine according to one aspect of the present invention comprises a lower traveling body, an upper swivel body located above the lower traveling body and provided to be swivelable with respect to the lower traveling body, an electric motor arranged in the upper swivel body, a hydraulic pump arranged in the upper swivel body and driven by the electric motor, a battery unit arranged in the upper swivel body and storing electric power to drive the electric motor, and a hydraulic actuator driven by hydraulic oil supplied from the hydraulic pump. The upper swivel body has a swivel frame at a bottom portion thereof, the battery unit is arranged on the swivel frame, and the electric motor and the hydraulic pump are arranged on the swivel frame, side by side in a left-right direction of the upper swivel body.

Advantageous Effects of Invention

Even when a large-capacity (large-size) battery unit is used, good balance of a machine body can be maintained during work.

DESCRIPTION OF EMBODIMENTS

The following is a description of an embodiment of the present invention based on the drawings.

[1. Electric Work Machine]

Figure 1:
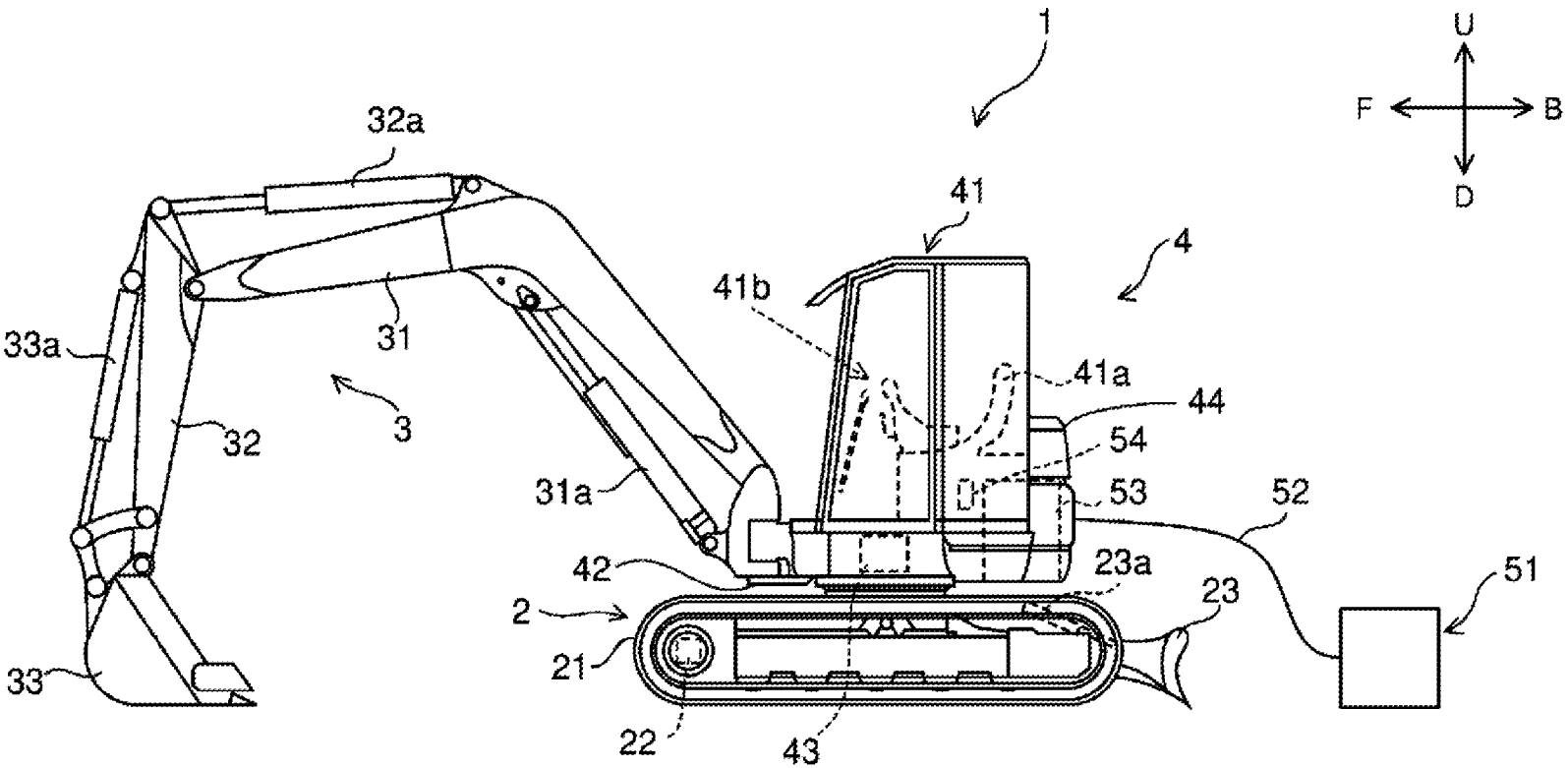
FIG. 1 is a side view showing a schematic configuration of a hydraulic excavator, which is an example of an electric work machine according to an embodiment of the present invention.

FIG. 1 is a side view showing a schematic configuration of a hydraulic excavator 1 which is an example of an electric work machine according to the present embodiment. The hydraulic excavator 1 comprises a lower traveling body 2, a work equipment 3, and an upper swivel body 4.

Here, directions are defined as follows. A direction in which an operator (manipulator, driver) sitting in a driver seat 41*a* of the upper swivel body 4 faces front is referred to as forward, and the opposite direction is referred to as backward. Therefore, when the upper swivel body 4 is in a non-swivel state (swivel angle 0°) with respect to the lower traveling body 2, a front-back direction of the upper swivel body 4 is the same as the direction in which the lower traveling body 2 moves forward and backward. Also, the left side is referred to as "left" and the right side is referred to as "right" as viewed from the operator sitting in the driver seat 41*a*. Further, the gravity direction perpendicular to the front-back and left-right directions is referred to as an up-down direction, with the upstream side of the gravity direction being "up" and the downstream side being "down." In the drawing, the upper swivel body 4 is shown in a non-swivel state with respect to the lower traveling body 2, with the symbols "F" for forward, "B" for backward, "R" for right, "L" for left, "U" for upward, "D" for downward, as necessary.

The lower traveling body 2 comprises a pair of left and right crawlers 21 and a pair of left and right traveling motors 22. Each of the traveling motors 22 is a hydraulic motor. The left and right traveling motors 22 drive the left and right crawlers 21, respectively, thereby making it possible to the hydraulic excavator 1 forward and backward. The lower traveling body 2 is provided with a blade 23 and a blade cylinder 23*a* for ground leveling work. The blade cylinder 23*a* is a hydraulic cylinder to rotate the blade 23 in the up-down direction.

The work equipment 3 comprises a boom 31, an arm 32, and a bucket 33. The boom 31, the arm 32, and the bucket 33 can be independently driven to perform excavation of earth and sand, etc.

The boom 31 is rotated by a boom cylinder 31*a*. The boom cylinder 31*a* is supported at a base end portion thereof by a front portion of the upper swivel body 4 and is movable freely in an extendable and retractable manner. The arm 32 is rotated by an arm cylinder 32*a*. The arm cylinder 32*a* is supported at a base end portion thereof by a tip end portion of the boom 31 and is movable freely in an extendable and retractable manner. The bucket 33 is rotated by a bucket cylinder 33*a*. The bucket cylinder 33*a* is supported at a base end portion thereof by a tip end portion of the arm 32 and is movable freely in an extendable and retractable manner. The boom cylinder 31*a*, the arm cylinder 32*a*, and the bucket cylinder 33*a* are each constituted of a hydraulic cylinder.

The upper swivel body 4 is located above the lower traveling body 2 and provided to be swivelable with respect to the lower traveling body 2 via a swivel bearing (not shown). In the upper swivel body 4, an operation portion 41, a swivel frame 42, a swivel motor 43, an engine room 44, etc. are arranged. The upper swivel body 4 swivels via a swivel bearing by being driven by the swivel motor 43, which is a hydraulic motor.

A hydraulic pump 71 (see FIG. 2) is arranged in the upper swivel body 4. The hydraulic pump 71 is driven by an electric motor 61 (see FIG. 2) inside the engine room 44. The hydraulic pump 71 supplies hydraulic oil (pressure oil) to the hydraulic motors (e.g., left and right traveling motors 22, swivel motor 43), and the hydraulic cylinders (e.g., blade cylinder 23*a*, boom cylinder 31*a*, arm cylinder 32*a*, bucket cylinder 33*a*). The hydraulic motors and the hydraulic cylinders that are driven with the hydraulic oil supplied from the hydraulic pump 71 are collectively referred to as a hydraulic actuator 73 (see FIG. 2).

The driver seat 41*a* is arranged in the operation portion 41. Various levers 41*b* are arranged around the driver seat 41*a*. Upon the operator sitting in the driver seat 41*a* operates the lever 41*b*, the hydraulic actuator 73 is driven. This allows the lower traveling body 2 to travel, the blade 23 to perform ground leveling work, the work equipment 3 to perform excavation work, and the upper swivel body 4 to swivel, etc.

A battery unit 53 (e.g., lithium-ion battery unit) is arranged in the upper swivel body 4. The battery unit 53 stores electric power to drive the electric motor 61. The battery unit 53 may be constituted of a plurality of batteries as a unit or may be constituted of a single battery cell. Further, the upper swivel body 4 is provided with an unshown power feed port. The power feed port 50, and a commercial power supply 51 as an external power source are connected via a power supply cable 52. This allows the battery unit 53 to be charged.

The upper swivel body 4 is further provided with a lead battery 54. The lead battery 54 outputs a low-voltage (e.g., 12 V) direct-current (DC) voltage. The output from the lead battery 54 is supplied as a control voltage to, for example, a blower fan F (see FIG. 3) and a system controller 67 (see FIG. 2), which will be described later.

The hydraulic excavator 1 may be so configured as to be a combination of a hydraulic instrument such as a hydraulic actuator 73 and an actuator driven by electric power. The actuators driven by electric power include, for example, electric traveling motors, electric cylinders, and electric swivel motors.

[2. Configuration of Control and Hydraulic Systems]

Figure 2:
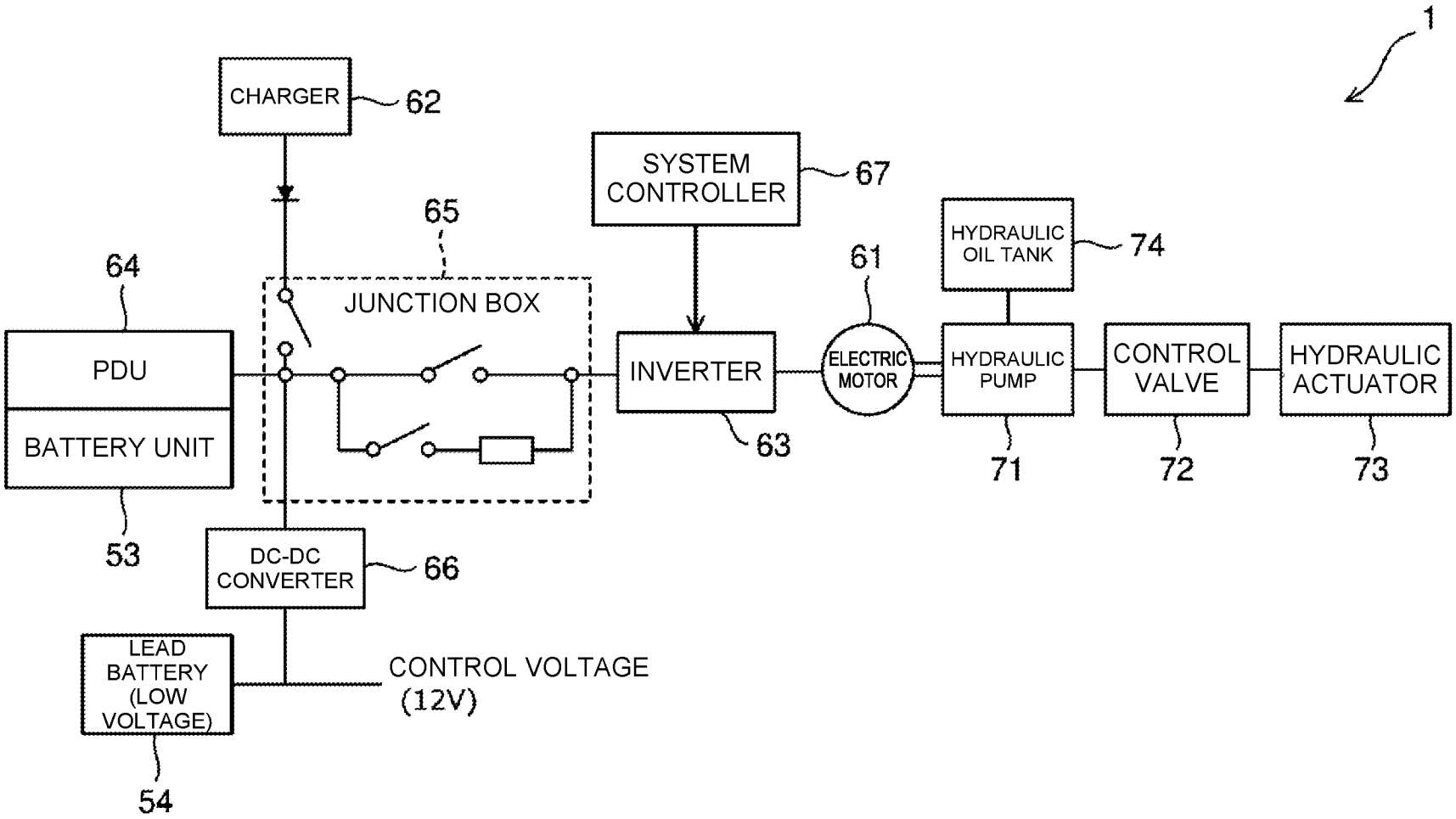
FIG. 2 is a block diagram schematically showing a configuration of control and hydraulic systems of the hydraulic excavator.

FIG. 2 is a block diagram schematically showing a configuration of control and hydraulic systems of the hydraulic excavator 1. The hydraulic excavator 1 comprises the electric motor 61, a charger 62, an inverter 63, a power drive unit (PDU) 64, a junction box 65, a DC-DC converter 66, and the system controller 67. The system controller 67 is constituted of an electronic control unit, also called an ECU, and electrically controls each part of the hydraulic excavator 1.

The electric motor 61 is driven by electric power supplied from the battery unit 53 via the junction box 65 and the inverter 63. The electric motor 61 is constituted of a permanent magnet motor or an induction motor.

The charger 62 converts an alternating-current (AC) voltage supplied from the commercial power supply 51 shown in FIG. 1 via the power supply cable 52 into a DC voltage. The inverter 63 converts a DC voltage supplied from the battery unit 53 into an AC voltage, and supplies the AC voltage to the electric motor 61. This rotates the electric motor 61. The supply of the AC voltage (current) from the inverter 63 to the electric motor 61 is based on a rotation command output from the system controller 67.

The PDU64 is a battery control unit that controls an internal battery relay thereby to control inputting and outputting of the battery unit 53. The junction box 65 includes a charger relay, an inverter relay, a fuse, etc. The voltage output from the charger 62 is supplied to the battery unit 53 via the junction box 65. Further, the voltage output from the battery unit 53 is supplied to the inverter 63 via the junction box 65.

The DC-DC converter 66 steps down a high-voltage (e.g., 300 V) DC voltage supplied from the battery unit 53 to a lower voltage (e.g., 12 V). Like the output from the lead battery 54, the voltage output from the DC-DC converter 66 is supplied to the blower fan F, the system controller 67, etc.

A plurality of the hydraulic pumps 71 are connected to a rotary shaft (output shaft) of the electric motor 61. The plurality of the hydraulic pumps 71 include variable displacement and fixed displacement pumps. FIG. 2 shows one hydraulic pump 71 only as an example. Each hydraulic pump 71 is connected to a hydraulic oil tank 74 that contains hydraulic oil. The hydraulic pump 71 causes the hydraulic oil in the hydraulic oil tank 74 to be supplied through a control valve 72 to the hydraulic actuator 73. This drives the hydraulic actuator 73. The control valve 72 is a direction-switching valve that controls a flow direction and a flow rate of the hydraulic oil supplied to the hydraulic actuator 73.

As described above, the hydraulic excavator 1 in this embodiment comprises at least the electric motor 61, the hydraulic pump 71, and the battery unit 53, which are arranged in the upper swivel body 4 (see FIG. 1). Also, the hydraulic excavator 1 comprises the hydraulic actuator 73 driven by the hydraulic oil supplied from the hydraulic pump 71.

[3. Arrangement of Each Component Inside Engine Room]

Figure 3:
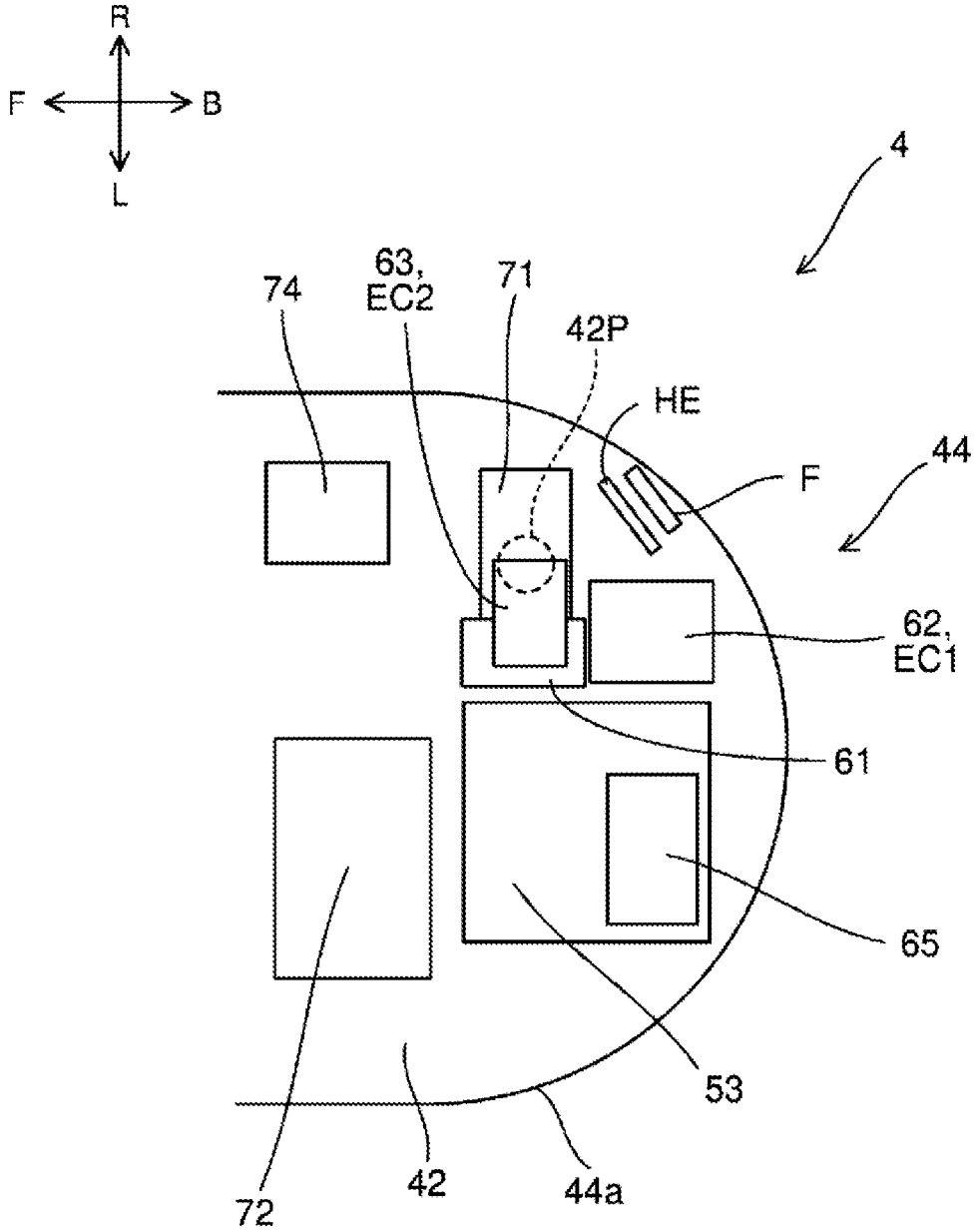
FIG. 3 is a plan view schematically showing an arrangement of each component in an engine room of an upper swivel body provided with the hydraulic excavator.
Figure 4:
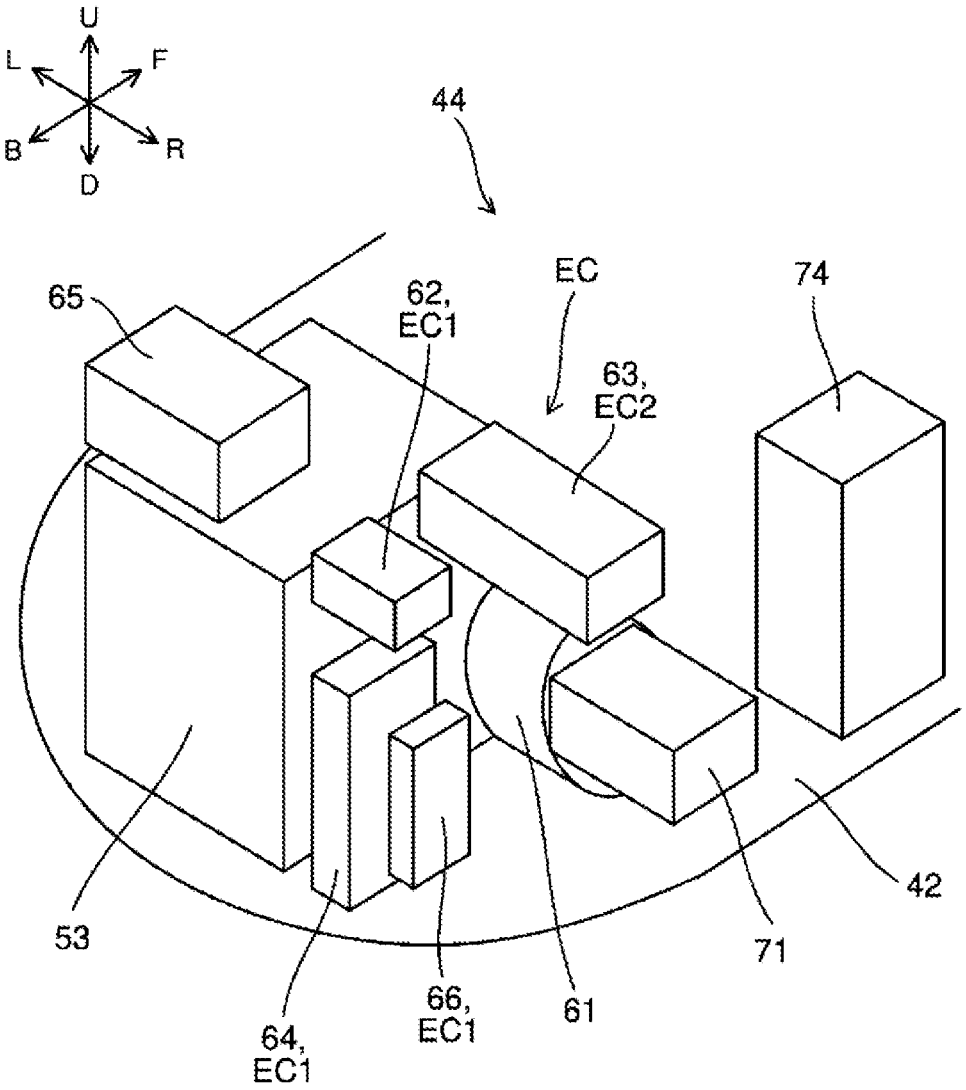
FIG. 4 is a perspective view schematically showing the arrangement of each component in the engine room.

FIGS. 3 and 4 are a plan view and a diagrammatic view, respectively, showing schematically arrangements of each component in the engine room 44 of the upper swivel body 4. In FIGS. 3 and 4, each component is shown in a simple rectangular or cylindrical shape for simplification, but the actual shape may differ from these. Further, a seat mount is not shown in FIGS. 3 and 4. The seat mount is a pedestal that constitutes an upper wall of the engine room 44 and serves as a base for the driver seat 41*a* shown in FIG. 1. Further, in FIG. 4, the blower fan F and a heat exchanger HE shown in FIG. 3 are omitted for convenience.

The upper swivel body 4 has a swivel frame 42 at a bottom portion thereof. The swivel frame 42 constitutes a bottom plate of the upper swivel body 4. The battery unit 53 is arranged on the swivel frame 42. Further, the electric motor 61 and the hydraulic pump 71 are also arranged on the swivel frame 42 (out of alignment with the battery unit 53). In particular, the electric motor 61 and the hydraulic pump 71 are arranged on the swivel frame 42, side by side in the left-right direction of the upper swivel body 4.

More specifically, on the swivel frame 42, the battery unit 53 is arranged on the left side. On the other hand, the electric motor 61 and the hydraulic pump 71 are arranged on the right side of the battery unit 53 and are arranged side by side in the left-right direction. In other words, on the swivel frame 42, the battery unit 53 is arranged on one side in the left-right direction, and the electric motor 61 and the hydraulic pump 71 are arranged on the other side in the left-right direction with respect to the battery unit 53. The output shaft of the electric motor 61 and an input shaft of the hydraulic pump 71 are located along the left-right direction.

There are support structures such as anti-vibration rubbers, stays, housings, etc. between the battery unit 53, the electric motor 61, the hydraulic pump 71, and the swivel frame 42, but the above support structures are not shown in the drawings.

Since the electric motor 61, the hydraulic pump 71, and the battery unit 53 are arranged on the same swivel frame 42, the center of gravity of the hydraulic excavator 1 can be lowered compared to a configuration in which the battery unit 53 is arranged above the electric motor 61, even when a large-size (large capacity) battery unit 53 is used.

Further, the electric motor 61 and the hydraulic pump 71 are arranged side by side on the swivel frame 42 in the left-right direction so that weight can be balanced in the left-right direction. More specifically, as the battery unit 53 becomes larger in size (larger capacity), the weight of the battery unit 53 becomes larger than the weight of the electric motor 61 alone and the weight of the hydraulic pump 71 alone. However, it is possible to bring the total weight of the electric motor 61 and the hydraulic pump 71 closer to the weight of the battery unit 53. Therefore, when the battery unit 53 is located off-center to the left side of the center on the swivel frame 42 as described above, the electric motor 61 and the hydraulic pump 71 can be arranged side by side (aligned in the left-right direction) on a side (e.g., on the right side) of the battery unit 53, so that it is possible to balance the weight between the left and right sides of the swivel frame 42.

Thus, even when the large-capacity (large-size) battery unit 53 is used, the center of gravity of the hydraulic excavator 1 can be lowered and the weight can be balanced on the left and right sides, so that even when the hydraulic actuator 73 is driven to perform work, good balance of the machine body of the hydraulic excavator 1 can be maintained, and work can be performed well with the hydraulic excavator 1 in a stable posture.

In addition, since the electric motor 61 and the hydraulic pump 71 are aligned in the left-right direction on the swivel frame 42, the electric motor 61, the hydraulic pump 71, and the battery unit 53 can be integrated and efficiently arranged in a limited space on the swivel frame 42 (e.g., backward on the swivel frame 42 as shown in FIG. 3), even when the large-size battery unit 53 is used. This can avoid the enlargement of the swivel frame 42 as much as possible, thereby avoiding the enlargement of the hydraulic excavator 1 as much as possible, even when the large-size battery unit 53 is used.

The electric motor 61 and the hydraulic pump 71 may be arranged in front of the battery unit 53 on the swivel frame 42. Even in this case, for example, the battery unit 53 is arranged in the center of the left-right direction, and the electric motor 61 and the hydraulic pump 71 are arranged side by side in the left-right direction in such a way that the total center of gravity of the electric motor 61 and the hydraulic pump 71 comes to the center of the left-right direction, so that the weight can be balanced in the left-right direction. As a result, good balance of the machine body of the hydraulic excavator 1 during work can be maintained in the same manner as described above.

In particular, in a configuration such as this embodiment, where the battery unit 53 is arranged on the one side on the swivel frame 42 in the left-right direction and the electric motor 61 and the hydraulic pump 71 are arranged on the other side on the swivel frame 42 in the left-right direction, it becomes easier to balance the weight in the left-right direction on the swivel frame 42 by arranging the electric motor 61 and the hydraulic pump 71 side by side in the left-right direction. Therefore, the configuration in which the electric motor 61 and the hydraulic pump 71 are arranged side by side in the left-right direction is very effective.

However, in FIG. 1, when the driver seat 41*a*, in which the operator sits, is positioned forward of, for example, the battery unit 53, it is necessary to form the swivel frame 42 longer in the front-back direction in order to position the driver seat 41*a* and the battery unit 53, which are aligned in the front-back direction, on the same swivel frame 42. This leads to a larger hydraulic excavator 1.

In this regard, as shown in FIG. 1, the driver seat 41*a* is located above the battery unit 53 in this embodiment. In this configuration, the positional relationship between the driver seat 41*a* and the battery unit 53 is overlapping when viewed from above, which makes it possible to shorten the length of the swivel frame 42 in the front-back direction. As a result, the hydraulic excavator 1 can be made smaller.

[4. Arrangement of Electrical Components]

The charger 62, the inverter 63, the PDU 64, and the DC-DC converter 66 are examples of electrical components EC. The electrical components EC are arranged in the engine room 44 together with the electric motor 61, the hydraulic pump 71 and the battery unit 53. The engine room 44 has the above-mentioned swivel frame 42 at a bottom portion thereof. In other words, the swivel frame 42 is the bottom portion of the upper swivel body 4 as well as the bottom portion of the engine room 44.

As shown in FIG. 3, the blower fan F is arranged on a side portion of the engine room 44. The blower fan F circulates air between inside and outside of the engine room 44. The blower fan F is arranged inside a hood 44*a*, which serves as a cover for the side portion of the engine room 44. The blower fan F may be constituted, for example, of an exhaust fan that discharges air from the inside of the engine room 44 to the outside, but the blower fan F may also be an intake fan that takes air from the outside of the engine room 44 into the inside. In other words, the blower fan F may be an exhaust type or an intake type.

Further, the heat exchanger HE is arranged at a position opposite to the blower fan F on the swivel frame 42. The heat exchanger HE includes a radiator for heat exchange of cooling medium and an oil cooler for heat exchange of the hydraulic oil. The cooling medium and the hydraulic oil are cooled by heat exchange when the airflow generated by the drive of the blower fan F is directed to the heat exchanger HE. In this embodiment, the cooling medium is supplied to the battery unit 53. In other words, the battery unit 53 is water-cooled. In addition, the electric motor 61, the charger 62, the inverter 63, the PDU64, and the DC-DC converter 66 is air-cooled.

In this embodiment, the blower fan F and the electrical components EC are located on the right side of the battery unit 53. In other words, in the left-right direction, the blower fan F and the electrical components EC are arranged on the same side where the electric motor 61 and the hydraulic pump 71 are arranged with respect to the battery unit 53.

In this configuration, air flow can be created in the engine room 44, for example on the right side of the battery unit 53, by the drive of the blower fan F. Then, air that is made to flow by the drive of the blower fan F is directed to the electrical components EC arranged on the right side of the battery unit 53, so that the electrical components EC can be cooled. Thus, even if the battery unit 53 is large, the electrical components EC can be cooled.

In particular, as shown in FIG. 3, in this embodiment, the swivel frame 42 has an opening portion 42P that communicates with the inside of the engine room 44. The forming position of the opening portion 42P in the swivel frame 42 is not particularly limited, but for example, the opening portion 42P is formed at a position below the hydraulic pump 71 in the swivel frame 42.

In this configuration, when the blower fan F is driven, air is sucked into the engine room 44 through the opening portion 42P from below the engine room 44, and the sucked air can be discharged from the side portion of the engine room 44 to the outside of the engine room 44 via the blower fan F. This air flow allows for efficient cooling of the electrical components EC in the engine room 44.

In particular, from the perspective of cooling the electrical components EC, it is best to allow fresh outdoor air to lick the electrical components EC as much as possible. As described above, by locating the opening portion 42P below the hydraulic pump 71, which overlaps with the inverter 63, in the swivel frame 42, air (cooling air) sucked in from below through the opening portion 42P licks the electrical components EC such as the inverter 63 and is discharged by the blower fan F. This allows the cooling efficiency of the electrical components EC to be improved.

The electrical components EC described above may include a first electrical component EC1. The first electrical component EC1 is an electrical component located in the engine room 44, behind the electric motor 61. In the examples in FIGS. 3 and 4, the charger 62, the PDU 64, and the DC-DC converter 66 are located in the engine room 44 and are located behind the electric motor 61, any of which corresponds to the first electrical component EC1. Note that any one or two of the charger 62, the PDU 64, and the DC-DC converter 66, as the first electrical component EC1, may be located behind the electric motor 61.

This arrangement of the first electrical component EC1 allows the space behind the electric motor 61 in the engine room 44 can be effectively utilized.

In particular, the first electrical component EC1 includes at least any one of the charger 62, the PDU 64, and the DC-DC converter 66. In this case, by arranging at least any one of the charger 62, the PDU 64, and the DC-DC converter 66 behind the electric motor 61, the above space behind the electric motor 61 can be effectively utilized.

The electrical components EC described above may include a second electrical component EC2. The second electrical component EC2 is an electrical component located in the engine room 44, above at least one of the electric motor 61 and the hydraulic pump 71. In the examples in FIGS. 3 and 4, the inverter 63 is located in the engine room 44 above the electric motor 61 and above the hydraulic pump 71, and corresponds to the second electrical component EC2.

This arrangement of the second electrical component EC2 allows the space above at least one of the electric motor 61 and the hydraulic pump 71 in the engine room 44 can be effectively utilized.

In particular, the second electrical component EC2 includes the inverter 63. The above arrangement of the inverter 63 can make effective utilization of the space above at least one of the electric motor 61 and the hydraulic pump 71.

Note that the first electrical component EC1 includes, but is not limited to, at least any one of the charger 62, the PDU 64, and the DC-DC converter 66. Further, the second electrical component EC2 is not limited to the inverter 63. In other words, the arrangement position of the charger 62, the PDU 64, the inverter 63, and the DC-DC converter 66 can be changed as needed. Thus, at least any one of the charger 62, the PDU 64, and the DC-DC converter 66 can also be the second electrical component EC2. Similarly, the inverter 63 can also be the first electrical component EC1.

[5. Arrangement of Hydraulic Components]

As shown in FIG. 3, the hydraulic oil tank 74 described above is arranged in the engine room 44, in front of the hydraulic pump 71. On the other hand, the control valve 72 described above is arranged in the engine room 44, in front of the battery unit 53.

This arrangement of the hydraulic oil tank 74 and the control valve 72 can make effective utilization of the available space at the front in the engine room 44. Further, in the engine room 44, the hydraulic system components except the hydraulic pump 71 are located in the front, while the battery unit 53 and the electrical components EC are located in the rear. In other words, the hydraulic system components and the electrical system components can be arranged separately in the front-back direction. This arrangement can reduce the risk of adverse effects caused by the transfer of heat from the hydraulic system components, which become hot during use of the hydraulic excavator 1, to the battery unit 53 and the electrical components EC.

The description has been made with the hydraulic excavator 1, which is a construction machine, as the example of the electric work machine, but the electric work machine is not limited to the hydraulic excavator 1 and may be any other construction machine such as a wheel loader. Also, the electric work machine may be an agricultural machine such as a combine harvester, or a tractor.

The embodiment of the present invention has been described above, but the scope of the invention is not limited thereto. The invention can be carried out within an extended or modified range without departing from the gist of the invention.

INDUSTRIAL APPLICABILITY

The present invention is applicable to work machines such as a construction machine and an agricultural machine, for example.

REFERENCE SIGNS LIST

1 hydraulic excavator (electric work machine)
2 lower traveling body
4 upper swivel body
41*a* driver seat
42 swivel frame

42P opening portion
44 engine room
53 battery unit
61 electric motor
62 charger
63 inverter
64 PDU (battery control unit)
66 DC-DC converter
71 hydraulic pump
72 control valve
73 hydraulic actuator
74 hydraulic oil tank
F blower fan
EC electrical components
EC1 first electrical component
EC2 second electrical component

The invention claimed is:

1. An electric work machine comprising:
a lower traveling body;
an upper swivel body located above the lower traveling body and provided to be swivelable with respect to the lower traveling body;
an electric motor arranged in the upper swivel body;
a hydraulic pump arranged in the upper swivel body and driven by the electric motor;
a battery unit arranged in the upper swivel body and storing electric power to drive the electric motor; and
a hydraulic actuator driven by hydraulic oil supplied from the hydraulic pump, wherein
the upper swivel body has a swivel frame at a bottom portion thereof,
the battery unit is arranged on the swivel frame, and
the electric motor and the hydraulic pump are arranged side by side in a left-right horizontal direction on the swivel frame.

2. The electric work machine according to claim 1, wherein on the swivel frame, the battery unit is arranged on one side in the left-right direction, and the electric motor and the hydraulic pump are arranged on the other side in the left-right direction with respect to the battery unit.

3. The electric work machine according to claim 2, wherein the upper swivel body comprises:
an engine room having the swivel frame;
an air blower fan arranged on a side portion of the engine room to circulate air between inside and outside of the engine room; and
electrical components arranged in the engine room, wherein
the air blower fan and the electrical components are arranged on the same side where the electric motor and the hydraulic pump are arranged with respect to the battery unit in the left-right direction.

4. The electric work machine according to claim 3, wherein the swivel frame has an opening portion that communicates with the inside of the engine room.

5. The electric work machine according to claim 3, wherein the electrical components include a first electrical component located in the engine room, behind the electric motor.

6. The electric work machine according to claim 5, wherein the first electrical component includes at least any one of:
a charger that converts an alternating-current (AC) voltage supplied from a commercial power supply to a direct-current (DC) voltage;
a DC-DC converter that steps down the DC voltage output from the charger or a DC voltage supplied from the battery unit; and
a battery control unit that controls inputting and outputting of the battery unit.

7. The electric work machine according to claim 5, wherein the electrical components include a second electrical component located in the engine room above at least one of the electric motor and the hydraulic pump.

8. The electric work machine according to claim 7, wherein the second electrical component includes an inverter that converts a DC voltage supplied from the battery unit to an AC voltage and supplies the AC voltage to the electric motor.

9. The electric work machine according to claim 3, further comprising:
a hydraulic oil tank that contains the hydraulic oil; and
a control valve that controls a flow direction and a flow rate of the hydraulic oil supplied to the hydraulic actuator, wherein
the hydraulic oil tank is arranged in the engine room, in front of the hydraulic pump, and
the control valve is arranged in the engine room, in front of the battery unit.

10. The electric work machine according to claim 1, further comprising a driver seat in which an operator sits, wherein
the driver seat is located above the battery unit.

* * * * *